US005090867A

United States Patent [19]

Ormenese

[11] Patent Number: 5,090,867

[45] Date of Patent: Feb. 25, 1992

[54] ROTATING FLUID MACHINE FOR REVERSIBLE OPERATION FROM TURBINE TO PUMP AND VICE-VERSA

[76] Inventor: Carlo Ormenese, via S. G. Bosco No. 19, 15061 Arquata Scrivia (Alessandria), Italy

[21] Appl. No.: 554,569

[22] Filed: Jul. 19, 1990

[30] Foreign Application Priority Data

Jul. 21, 1989 [IT] Italy ..... 67618 A/89

[51] Int. Cl.[5] ..... F01D 5/02

[52] U.S. Cl. ..... 415/141; 415/71; 415/152.1; 415/910; 415/911; 417/237

[58] Field of Search ..... 415/140, 141, 170.1, 415/182.1, 227, 71, 214.1, 215.1, 910, 911, 152.1, 152.2; 417/237, 423.14

[56] References Cited

U.S. PATENT DOCUMENTS 779,743 1/1905 Shaffer ..... 415/71

4,208,777 6/1980 Walsh et al. ..... 415/214.1

*Primary Examiner*—Edward K. Look

*Assistant Examiner*—Christopher M. Verdier

*Attorney, Agent, or Firm*—Keil & Weinkauf

[57] ABSTRACT

A rotating fluid machine for reversible operation from turbine to pump and from pump to turbine having a simple structure which allows for easy manipulation when reversing operation, and having a low change in efficiency when the machine operates in reverse. The fluid machine includes a bladed rotor containing a rotor spindle, a rotor disk, at least one radial groove, a carrying pin integral to the rotor disk, and at least one rotor blade. The blade, which controls the fluid flow, possesses two identical tongues that extend symmetrically with respect to the axis of the carrying pin and protrude with respect to the rotor disk. The machine possesses an external duct for input of the fluid to the fluid duct. The blade of the carrying pin then rotates in accordance with the toroidal structure of the bladed rotor, allowing the fluid to pass through three passages and to exit by way of a second external duct. An associated casing, comprised of two structurally identical, tightly interconnected semishells, contains the bladed rotor and forms channels which constitute the vanes of the fluid duct.

6 Claims, 5 Drawing Sheets

ROTATING FLUID MACHINE FOR REVERSIBLE OPERATION FROM TURBINE TO PUMP AND VICE-VERSA

BACKGROUND OF THE INVENTION

1. Filed of the Invention

The present invention relates to a rotating fluid machine for reversible operation from turbine to pump and vice-versa. Previous machines operating as pumps and turbines have usually been divided into two basic categories: Axial and radial, to which we must add the category of reciprocating pumps. The Pelton wheel turbine stands almost alone as a volumetric efficiency turbine, while other turbines show volumetric losses that are even higher, as a result of which a portion of the fluid fails to work 2. Description of the Related Art However, in all types of turbines, including gas turbines, reversibility is not possible except at a cost of substantial loss of efficiency, while reversing rotation is possible only with the aid of elaborate systems for reversing the pitch of the blades Even here, however, we find only emergency (hence low-efficiency) systems.

Where pumps and compressors are concerned, there is one category having a volumetric efficiency of one, i.e., reciprocating piston pumps and compressors, which do however suffer from the drawback that they have just one alternating flow.

Yet even with machines of this type, we find the same kinds of shortcomings as with turbines, namely, that reversibility is minimal and that it is impossible to reverse the flow.

SUMMARY OF THE INVENTION

The primary purpose of this invention is to provide a rotating fluid machine for reversible operation from turbine to pump and vice-versa, with a simplified structure, that will make it possible to switch operation without major changes in efficiency, and that will also make it possible to reverse the direction of rotation without repercussions on efficiency.

A further purpose is to provide a rotating fluid machine of the type specified, that is both safe and reliable to operate, easy to install and maintain, and relatively simple to manufacture.

Yet another purpose is to provide a rotating machine of the type described that can find practical applications in major industrial plants—i.e., as a means of replacing mechanical transmissions for small- and medium-capacity machinery—as well as for motor vehicles, scrapers, excavators, trucks, machines in general, et cetera.

With a view to achieving these purposes, the present invention makes provision for a rotating fluid machine for reversible operation from turbine to pump and vice-versa, the primary feature of which is dealt with in claim 1, which shall herein be deemed to have been set forth in its entirety.

Further beneficial features shall emerge in the subclaims, which shall likewise herein be deemed to have been set forth in their entirety.

The machine according to the invention does lend itself to reversible applications as a turbine and as a pump, without appreciable variations in efficiency, and without any modification being entailed by such a conversion. This is because the distributor and diffuser are identical from the manufacturing point of view—something which also makes it possible for rotation to be reversed without repercussions on efficiency. To reverse rotation in turbines, one need simply reverse the intake and discharge pipe fittings, and to reverse rotation in pumps, one need simply reverse the delivery and suction pipe fittings.

The machine according to the invention has a volumetric efficiency virtually equal to one in the case of liquids, and a volumetric efficiency of close to one in the case of gases, due to the special structure and arrangement of the rotor blade, which operates at all times with just one of its halves, and which forms a near-perfect seal with dense fluids (water-liquids), and a comparatively high degree of seal with less dense fluids (gases).

Further advantages are attributable to the continuity of rotation (in the case of turbines) and continuity of flow (in the case of pumps).

BRIEF DESCRIPTION OF THE DRAWINGS

The nature of the invention will become clearer after the following detailed description of one particular embodiment of the invention, with reference to the attached drawings, supplied by way of examples, in which.

DESCRIPTION OF THE PREFERRED EMBODIMENTS

Figure 2:
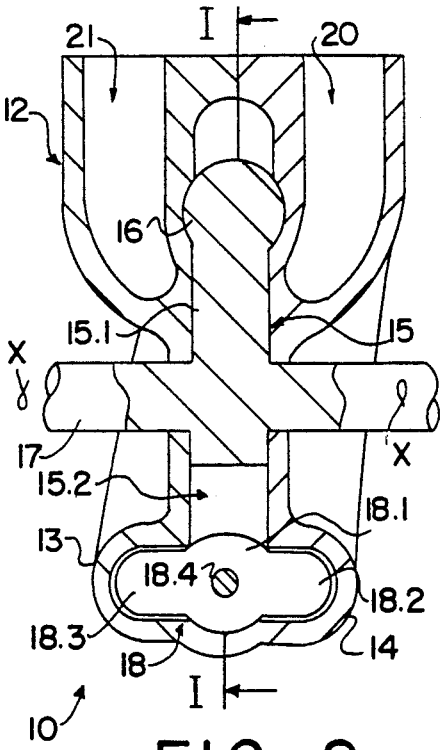
FIG. 2 is a cross-sectional view according to line II—II in FIG. 1.
Figure 11:
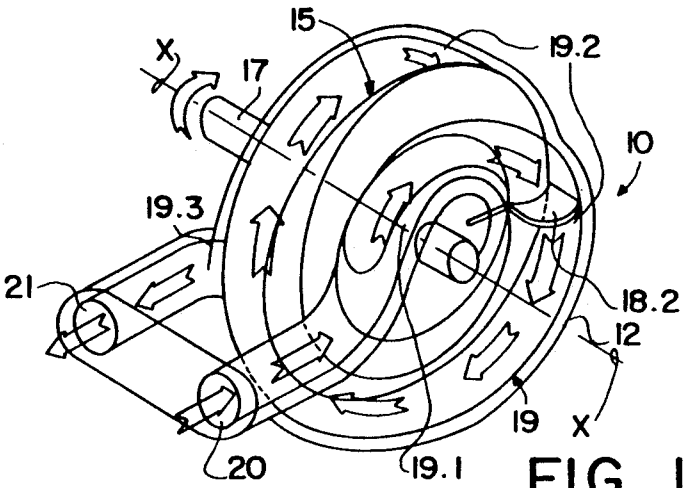

With reference to the drawings, the rotating fluid machine according to the invention is marked "10" in its entirety (FIGS. 2 and 11).

The machine 10 essentially comprises two fundamental parts: One bladed rotor 11 (FIG. 1) and one casing 12 (FIG. 2).

According to the illustrated embodiment, casing 12 is comprised of two structurally identical semishells 13, 14, tightly interconnected by means of a well-known method, e.g., by welding (FIGS. 1-6).

The bladed rotor 11 is comprised of one rotor disk 15, the central portion 15.1 of which possesses parallel plane faces, and which carries—e.g., in an integral body—an external peripheral thickening 16 with a substantially toroidal surface. Coaxially—and, for example, in a body integral with disk 15—is rotor spindle 17.

Rotor disk 15 carries—integral in rotation around its axis of rotation X—X—a blade 18, that can freely rotate with respect to the disk itself.

Blade 18 is comprised of a discoidal intermediate body 18.1 with parallel plane faces and having a radius substantially equivalent to the radius of the circle generating the toroidal thickening 16. Two identical and diametrically opposed plane tongues 18.2, 18.3, protrude from discoidal body 18.1 in coplanar fashion. These plane tongues possess rounded edges and have a width substantially equal to the thickness of the central portion 15.1 of rotor disk 15.

Rotor disk 15 has a deep radial through groove, 15.2., that cuts the toroidal thickening 16 and part of the central portion 15.1 of said disk. The width of groove 15.2 is a little larger than the thickness of blade 18, which is arranged to rotate in the groove in question. It will be noted that the length of radial groove 15.2 is a little larger than the length of the diameter of discoidal body 18.1 and of one of the tongues 18.2, 18.3 of blade 18 (cf. FIGS. 4, 5). Blade 18 is supported in such a way that it may freely rotate in groove 15.2 by means of a carrying pin 18.4, integral to disk 15. The geometrical axis of pin 18.4 lies in the middle plane of disk 15 normal to the axis of rotation X—X of the disk itself (plane identified in FIG. 2 by cross-section line I—I) and is tangent, on that particular plane, with respect to the imaginary circumference described by the center of the circle generating the toroidal surface of the thickening 16 of disk 15.

Blade 18 has its discoidal body 18.1 included in the toroidal surface of thickening 16 and its two plane tongues 18.2., 18.3, extending symmetrically with respect to the axis of the carrying pin 18.4 and protruding with respect to the thickening 16.

It follows that rotor blade 18 rotates in a plane containing the axis of rotation X—X of rotor disk 15.

Figure 5:
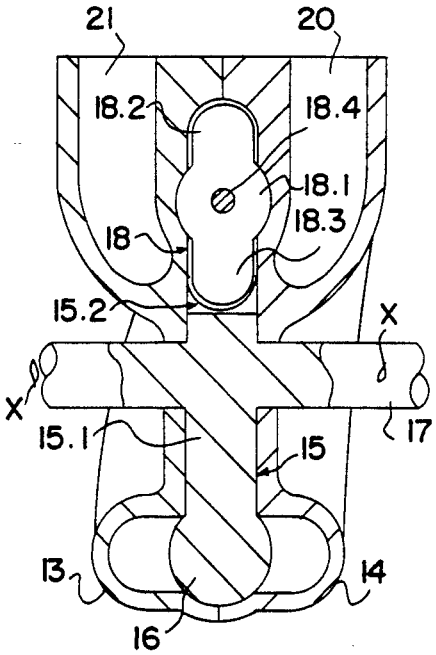
FIG. 5 is a cross-sectional view according to line V—V in FIG. 4.

It will be noted that in FIGS. 2 and 5, rotor blade 18 has not been split up into sections, for the sake of clarity of illustration.

Casing 12 serves a substantially threefold purpose:

It tightly connects the external suction/intake and delivery/discharge fluid ducts with one continuous internal fluid duct 19 (FIGS. 11-14) having a substantially helicoidal pattern;

By means of duct 19, casing 12 provides a continuous, tight guide for each in turn of the two tongues 18.2, 18.3 of blade 18 of rotor 11; and, Casing 12 provides a tight rotation housing for rotor disk 15 and associated spindle 17.

With particular reference to the FIGS. 7 thru 14, and bearing in mind that the two semishells 13, 14 are structurally identical and tightly assembled in a mutually counterposed arrangement to form a single cavity therebetween, with the fluid inlet and outlet standing side by side (cf. FIG. 2 and 11), we shall now describe the continuous fluid duct 19, which is formed by the tightly juxtaposed internal faces of semishells 13, 14. (In all the illustrations, the same parts are marked with the same reference numbers).

Following the direction of fluid passage, duct 19 may be substantially subdivided into three consecutive passages. The first passage 19.1 for suction (pump) or intake (turbine); a second work passage 19.2; and a third passage 19.3 for delivery (pump) or discharge (turbine).

The first passage 19.1 basically gets underway in the first semishell, 13 or 14, starting from inlet 20 for fluid suction or intake. Passage 19.1 extends from one zone close to one central bearing housing 17.1 for the rotor spindle 17, toward the peripheral edge of the semishell, with a channel-like pattern akin to a conical semispiral, and substantially occupying the quadrants marked Q1 and Q2 in FIG. 7.

The second passage 19.2 proceeds continuously in sequence from the first passage 19.1, substantially within the remaining two quadrants Q3 and Q4 of the abovementioned first semishell (albeit with a prolongation into Q1), as well as into the two quadrants of the other semishell 14 or 13 (tightly juxtaposed against the first semishell), facing the quadrants Q1 and Q2 of the first semishell. As will be appreciated, in quadrants Q1 and Q2 the other semishell has a structure identical to that of the first semishell in quadrants Q3, Q4. The second passage 19.2 has a substantially channel-like pattern akin to a cylindrical spiral (modified to accommodate the degree of radial extension of one tongue of blade 18 with respect to disk 15) and forms the larger-diameter cavity within the two semishells.

Finally, the third passage 19.3 proceeds in sequence from passage 19.2, and does so substantially in the two remaining quadrants of the second semishell 14 or 13, from a zone close to the peripheral edge of the semishell in question, toward one central bearing housing 17.1 for rotor spindle 17, with a channel-shaped pattern akin to a conical semispiral opposite to the pattern for the first passage 19.1 This third passage 19.3, substantially identical to the first passage 19.1, finally emerges into an outlet 21 for fluid delivery or discharge, side by side with inlet 20.

The tight rotation housing for rotor disk 15 inside casing 12 is comprised of two plane surfaces 22, one for each semishell, in the interior of the respective bearing housings 17.1 and counterposed to the plane faces of the central portion 15.1 of disk 15. This housing is further comprised of a pair of circular tracks 23, one for each semishell, partially surrounding the plane surfaces 22 and the first passage 19.1 (and the third passage 19.3 respectively) of duct 19, stretching as far as the initial portion (and the terminal portion respectively) of the second passage 19.2 of the duct. The toroidal thickening 16 of disk 15 is housed in a rotating fashion between this pair of mutually counterposed circular tracks 23. (In FIG. 7, for clarity of illustration, the plane surface 22 and the edge zone of the semishell that is to be tightly juxtaposed against the other semishell are shown in dashes).

The alternative embodiment illustrated in FIGS. 7 thru 10 differs from the embodiment illustrated in FIGS. 1-6 chiefly in that the semishell illustrated there is to be tightly connected to an identical semishell by means of screw-type removable connection devices, with a sealing gasket interposed (not shown).

Operation:

In phase with the rotation of rotor disk 15, blade 18 tightly fits and traverses, with one or other in turn of its tongues 18.2 or 18.3, the second passage 19.2 (work passage) of duct 19, while with the opposite tongue 18.3 or 18.2 it fits and traverses, without forming a seal, the other two passages 19.1, 19.3 of said duct, respectively constituting the fluid suction or intake passage and the fluid delivery or discharge passage.

Figure 1:
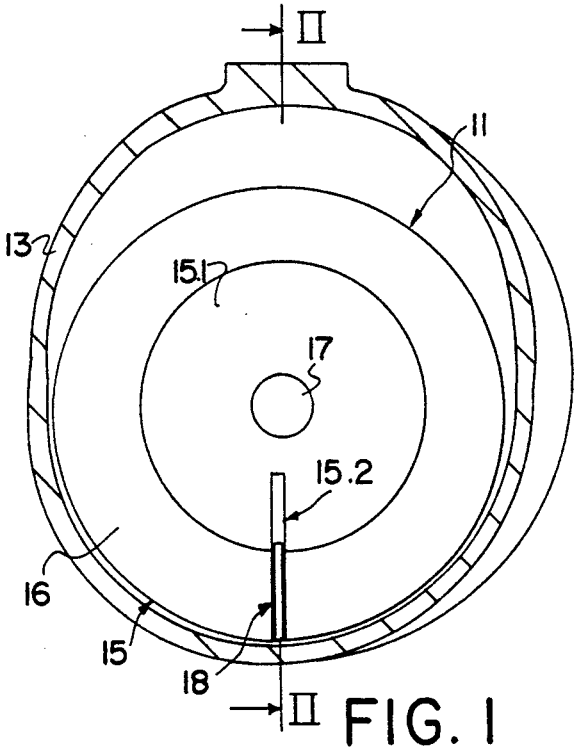
FIG. 1 is a schematic view, in a cross-section according to line I—I in FIG. 2, of the rotating fluid machine according to the invention, in which the bladed rotor is depicted in the startup position of a working phase.
Figure 3:
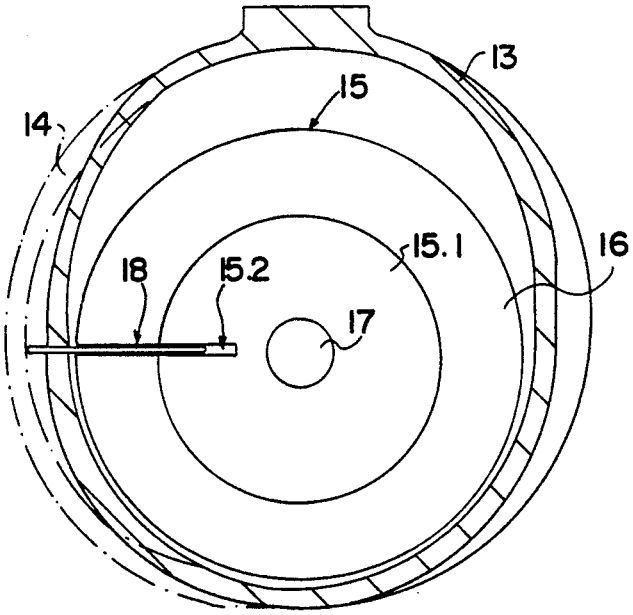
FIGS. 3, 4, and 6 are views similar to the view shown in FIG. 1, the difference being that the bladed rotor is illustrated after having been rotated 90, 180, and 270 degrees clockwise with respect to the position illustrated in FIG. 1 (in FIG. 3, dot-and-hyphen lines are used to indicate a portion of the other semishell, not visible in the cross-section, with respect to which the bladed rotor makes a seal in the rotation position shown in the same Figure)
Figure 4:
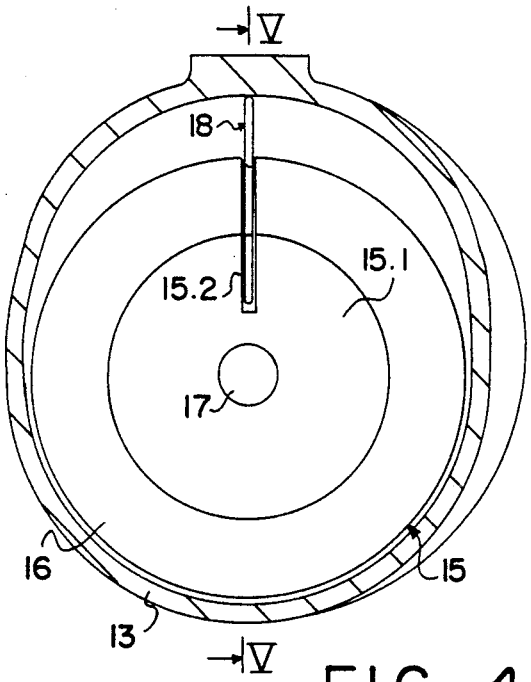
Figure 13:
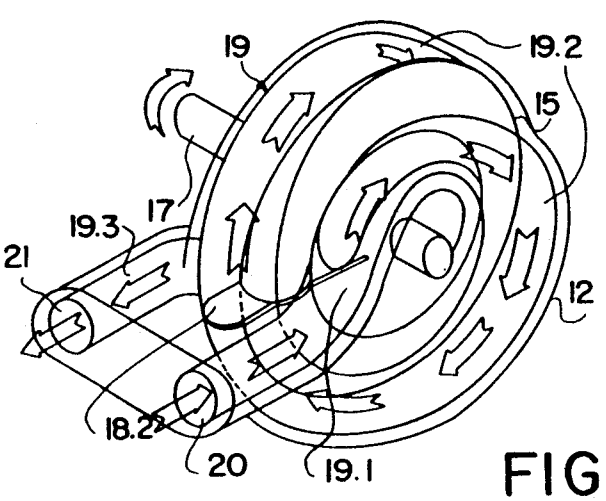
FIGS. 11 thru 14 are schematic views, in perspective, which illustrate how the rotating fluid machine operates according to the invention, showing the machine's working phases in substantially the same sequence as in FIGS. 1, 3, 4, and 6, and in which the casing is depicted with thin lines and the bladed rotor is viewed "transparently" through said casing.
Figure 14:
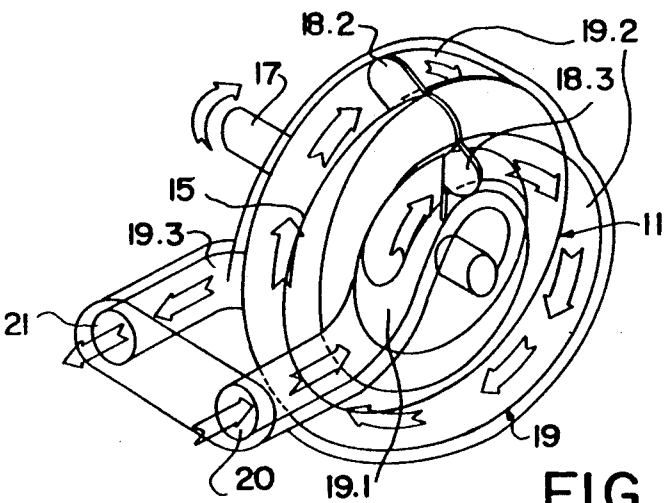
Figure 12:
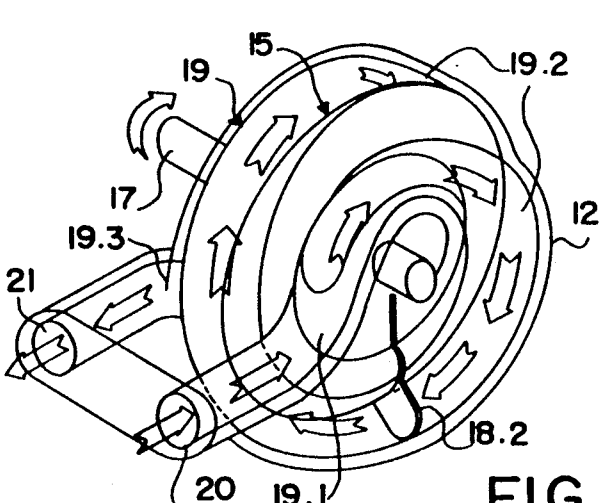

Specifically:

At the start of the work passage 19.2, rotor blade 18 has its longitudinal axis substantially parallel to the axis of rotation X—X of rotor disk 15 (FIGS. 1 and 11). In such a position, for example, the tongue 18.2 of the blade tightly fits and engages the initial portion of the work passage 19.2 of duct 19. If rotor disk 15 is rotated 180 degrees clockwise around axis X—X as in the drawings, blade 18 completes a 90 degree rotation around pin 18.4. Its tongue 18.2 thus tightly traverses the first half of work passage 19.2 of the duct 19, in which it is guided. In this rotation position, blade 18 has its longitudinal axis substantially normal with respect to the axis of rotation X—X of disk 15 (FIGS. 4 and 13). (The intermediate rotation phase is illustrated in FIGS. 3 and 12).

Figure 6:
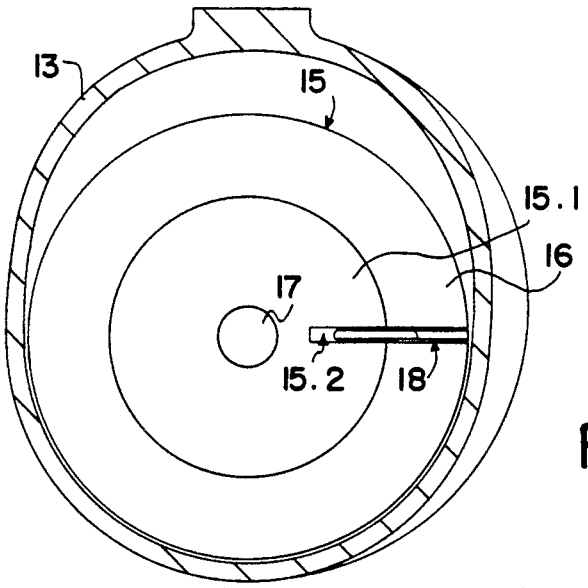
Figure 7:
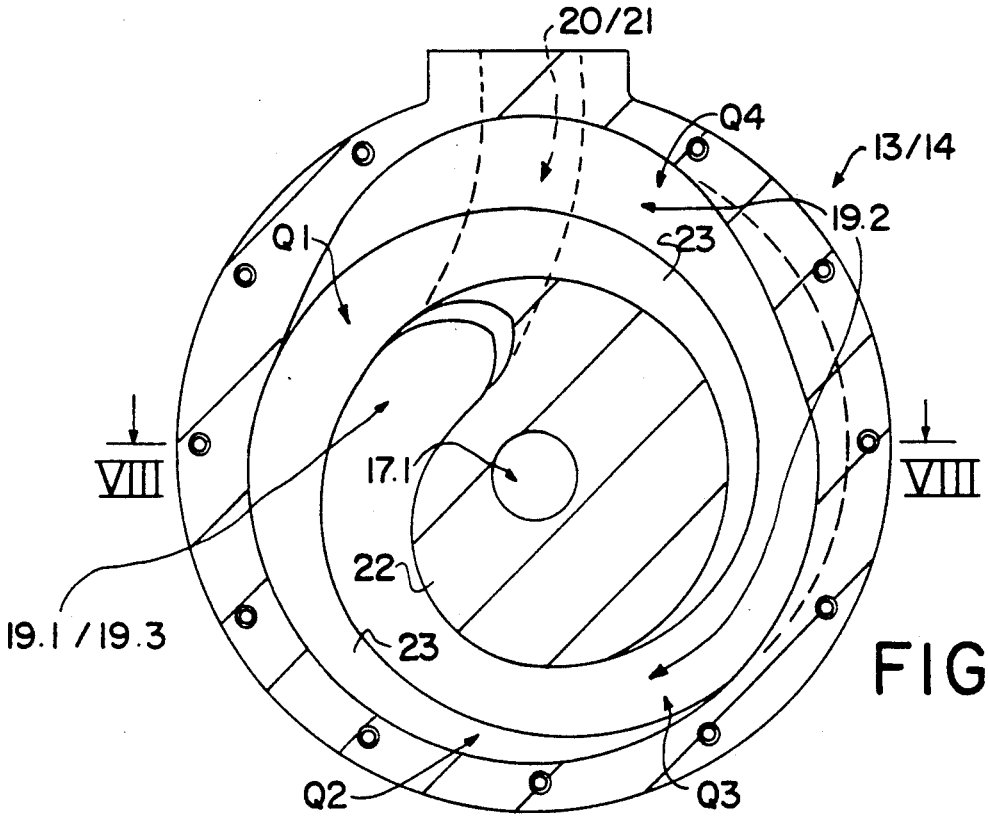
FIG. 7 is a plan view, seen from the inside and on a larger scale, of an alternative embodiment of one semishell of the casing for the rotating fluid machine according to the invention.
Figure 8:
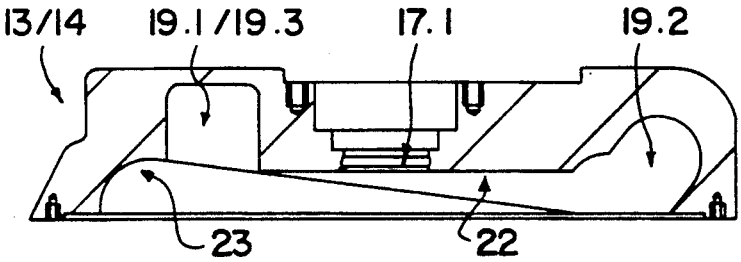
FIG. 8 is a cross-sectional view according to line VIII—VIII in FIG. 7.
Figure 9:
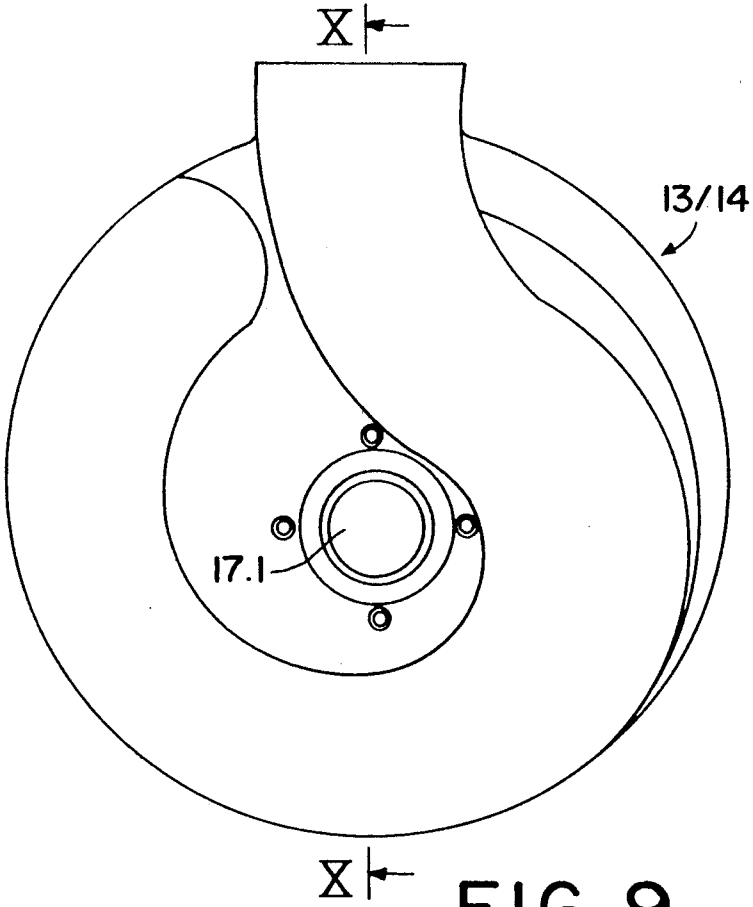
FIG. 9 is a view similar to the view shown in FIG. 7, albeit this time from the outside of the semishell.
Figure 10:
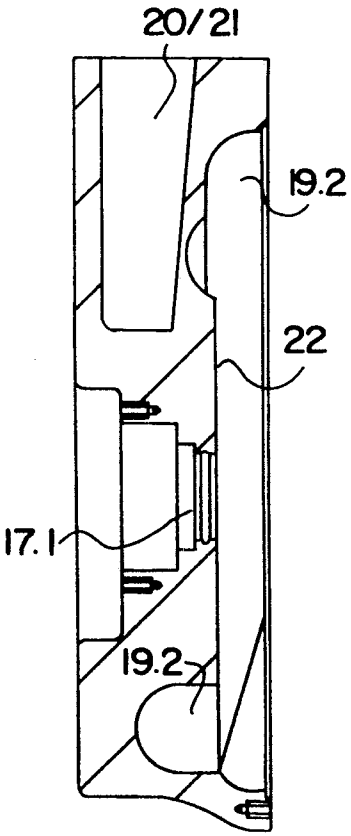
FIG. 10 is a cross-sectional view according to line X—X of FIG. 9.

If disk 15 is rotated a further 180 degrees clockwise around axis X—X, tongue 18.2 of blade 18 tightly traverses the remaining portion of work passage 19.2 of duct 19 in which it is guided, while blade 18 completes a further 90 degree rotation around pin 18.4 and comes once again to be arranged with its longitudinal axis substantially parallel to the axis of rotation X—X of disk 15. (The intermediate rotation phase is shown in FIGS. 6, 15).

In this rotation position, the other tongue 18.3 of blade 18 now tightly fits the beginning of the work passage 19.2 of the duct 19, in order to repeat, in phase with the clockwise rotation of disk 15, the same operating sequence described with reference to tongue 18.2.

This operation is repeated continuously, in the sense that a 360 degree rotation of rotor disk 15 around axis X—X goes hand in hand with a 180 degree rotation of blade 18 around pin 18.4. Or rather, for every two full rotations of the rotor disk 15 around axis X—X, the rotor blade 18 completes one full rotation around pin 18.4.

The tongue opposite to that tongue which from time to time is guided in the work passage 19.2 of duct 19, traverses in sequence the other two passages 19.1 and 19.3 of the duct, but without forming a seal and without being guided therein.

By reversing the direction of rotation, one brings about the reverse operation of machine 10.

As the foregoing considerations will have made clear, the blade 18 must always form a seal with one of its tongues against casing 12 while within the work passage 19.2 of duct 19 so that the fluid which from inlet 20 is drawn into the first passage 19.1 of duct 19, and then into the work passage 19.2, cannot overshoot the blade itself.

In operation as a pump, it is the blade which impels the fluid, while during operation as a turbine it is the fluid which impels the blade. In both cases, the fluid must not overshoot the blade in the work passage of duct 19.

The same seal must be inherent in rotor disk 15 with respect to its rotation housing, so as to ensure that the fluid cannot go into the rotor spindle 17, something which could impair the machine's efficiency, even if sealing gaskets were present (not shown in the drawings).

As we mentioned above, in the first passage 19.1 and third passage 19.3 of duct 19 the tongue of blade 18 which traverses them must not form a seal with respect thereto, nor must said blade be guided by said duct passages. That is because in these particular passages, it must be possible for the blade to be passed over by the fluid under pressure.

The connections made between the first and third passages of duct 19, and the second vane thereof, must be designed in such a way as to minimize hydraulic losses.

It goes without saying that any number of practical variations could be provided in connection with the foregoing description and illustrations—which are given by way of example and are not intended to be exhaustive—yet without thereby straying from the scope of the invention and hence from the purview of the industrial patent right at issue here.

Thus, as an example, even though a single-blade rotor has been described and illustrated here, one alternative would be to provide a rotor carrying, for example, one or more pairs of blades or an odd number of blades.

By the same token, the design of the rotor disk can be made to vary.

Designing the casing as two semishells is advantageous but not absolutely essential, and the same goes for the rotor blade design illustrated here.

I claim:

1. A rotating fluid machine for reversible operation from turbine to pump and vice-versa, comprising:

(a) a bladed rotor, containing
  (1) a rotor spindle;
  (2) a rotor disk, tightly rotating integral with and coaxial to said rotor spindle;
  (3) at least one radial groove, cutting through part of said rotor disk, emerging onto an external peripheral contour;
  (4) a carrying pin integral to said rotor disk; and
  (5) at least one rotor blade, possessing two identical tongues that extend symmetrically with respect to an axis of said carrying pin and protrude with respect to said rotor disk; said rotor blade being integral in rotation with said rotor disk and supported in said radial groove such that said rotor blade can freely rotate by means of said carrying pin;

(b) external ducts for fluid suction and fluid discharge;

(c) a casing containing said bladed rotor, possessing a continuous internal fluid duct,
  having a substantially helicoidal pattern, tightly connecting said external ducts to the beginning and end of said continuous internal duct, and following the direction of fluid passage,
  including a series of 3 passages of which
    a. the first passage proceeds from said external duct for fluid suction or intake, having a pattern which is substantially a conical semispiral, and extending as far as the external proximity of said casing;
    b. the second passage proceeds in sequence from said first passage, having a pattern which is substantially a cylindrical spiral modified to accommodate a degree of radial extension of one tongue of said rotor blade with respect to said rotor disk, and forming a cavity in said casing;

c. the third passage proceeds in sequence from said second passage, having a pattern which is substantially a conical semispiral, being opposite to said pattern of said first passage, and emerging into an outlet for fluid delivery or discharge;

wherein at least one blade of said bladed rotor is tightly engaged and guided in rotation around said axis with one or another of its tongues in turn in said second passage of said fluid duct in such a way that, at the start of said second duct passage, said rotor blade has its longitudinal axis substantially parallel to the axis of rotation of said rotor disk and in that position one of its tongues tightly fits and engages the initial portion of said second duct passage.

2. The rotating fluid machine according to claim 1, wherein said rotor disk possesses an external peripheral thickening with a substantially toroidal surface, and wherein said axis of said carrying pin is (a) always perpendicular to said axis of rotation of said rotor disk;

(b) tangential to said rotor disk; and (c) lies substantially in the middle of a height dimension of a cylindrical area swept out by said rotor disk.

3. The rotating fluid machine according to claim 2, wherein said rotor blade is comprised of an intermediate discoidal body with parallel plane faces and having a radius substantially equivalent to a radius of a circle generating said toroidal thickening, and wherein said plane tongues extend in coplanar fashion from said discoidal body in such a way that said rotor blade has its discoidal body included in the toroidal surface of said thickening.

4. The rotating fluid machine according to claim 2 wherein said rotor disk possesses a central portion having parallel plane faces.

5. The rotating fluid machine according to claim 1 wherein said casing is comprised of two structurally identical, tightly interconnected semishells, together forming (a) one central bearing housing for said rotor spindle, (b) a tight rotation housing for said rotor disk, (c) a channel, having the shape of a semispiral with a substantially conical pattern, forming said first passage and said third passage respectively of said fluid duct inside said casing, and (d) a channel having the shape of a prolonged semispiral, with a substantially cylindrical pattern modified to accommodate the degree of radial extension of one tongue of said rotor blade with respect to said rotor disk, connected to the conically-patterned semispiral channel and delineating substantially one half of said second passage of said fluid duct.

6. The rotating fluid machine according to claim 4 wherein said casing is comprised of two structurally identical, tightly interconnected semishells, together forming a tight rotation housing for said rotor disk with each semishell comprising (a) one central bearing housing for said rotor spindle, (b) a plane surface inside said central bearing housing and counterposed to said respective plane face of said central portion of said rotor disk, and (c) a circular track partially surrounding said plane surface and said first passage and third passage respectively of said fluid duct.

* * * * *